US005163812A

United States Patent [19]

Klaus

[11] Patent Number: 5,163,812

[45] Date of Patent: Nov. 17, 1992

[54] ROTARY PUMP WITH A PERMANENT MAGNETIC DRIVE

[75] Inventor: Franz Klaus, Bochum, Fed. Rep. of Germany

[73] Assignee: Franz Klaus Union Armaturen, Pumpen GmbH & Co., Bochum, Fed. Rep. of Germany

[21] Appl. No.: 634,397

[22] Filed: Dec. 27, 1990

[30] Foreign Application Priority Data

Dec. 29, 1989 [DE] Fed. Rep. of Germany ..... 3943273

[51] Int. Cl.[5] ..... F04D 29/08

[52] U.S. Cl. ..... 415/171.1; 415/111; 415/112; 384/404

[58] Field of Search ..... 415/171.1, 110, 111, 415/112; 417/423.12, 423.13; 384/412, 414, 404, 403, 472

[56] References Cited

U.S. PATENT DOCUMENTS

| | | | |
|---|---|---|---|
| 2,789,021 | 4/1957 | Pedersen | 384/472 |
| 2,884,284 | 4/1959 | Bohn | 384/404 |
| 3,155,043 | 11/1964 | Klaus | 415/112 |
| 3,340,813 | 9/1967 | Keyes | 415/112 |
| 4,120,618 | 10/1978 | Klaus | 417/420 |
| 4,596,476 | 6/1986 | Schill et al. | 384/472 |
| 4,812,108 | 3/1989 | Kotera | 415/111 |

*Primary Examiner*—John T. Kwon

*Attorney, Agent, or Firm*—Banner, Birch, McKie & Beckett

[57] ABSTRACT

A rotary impeller pump having a permanent magnetic drive is disclosed. An impeller disposed on a rotating shaft which is supported by a bearing assembly within a housing assembly. The bearing assembly is supported by a fixed ring assembly having a channel disposed therethrough, with one open end of the channel terminating above and adjacent the bearing assembly. A scoop wheel is disposed to rotate with the impeller and shaft. The scoop wheel raises fluid from a location below the bearing assembly to a location above the bearing assembly and adjacent a second open end of the channel. During normal operation, the housing assembly is substantially filled with the fluid medium to be pumped, and the fluid medium provides lubrication and cooling for the bearing assembly. Accordingly, if the pump is accidentally operated when a substantial portion of the fluid is drained from the interior of the pump, the scoop wheel ensures adequate lubrication by scooping residual fluid which collects at the bottom of the pump to a location adjacent the second open end of the channel, with the scooped fluid circulating through and lubricating the bearing assembly via the channel.

18 Claims, 3 Drawing Sheets

ROTARY PUMP WITH A PERMANENT MAGNETIC DRIVE

BACKGROUND OF THE INVENTION

1. Field of the Invention

The present invention is directed to a rotary pump including an impeller, a shaft and a rotor and having a permanent magnetic drive, and more particularly, to the lubrication of the plain bearing assembly which supports the shaft.

2. Description of the Prior Art

Rotary pumps including an impeller integrally formed with or fixedly attached to a rotary shaft are known in the prior art, for example, as disclosed in U.S Pat. No. 4,120,618, which is incorporated by reference. A rotor, shaft and impeller are integrally formed, and a plurality of permanent magnets are disposed circumferentially about the rotor, within the cylindrical section of an isolation shell. A corresponding plurality of permanent magnets are disposed on the interior of an outer rotor, across the shell from the first set of magnets. The magnets are disposed with opposite poles opposing each other across the cylindrical section of the shell. Therefore, rotation of the outer rotor causes corresponding rotation of the rotor, shaft and impeller. The impeller is part of a normal rotary pump which is well known to the person skilled in the art. In normal operation, the fluid to be pumped is present substantially throughout the entire interior of the pump, including the region occupied by the bearing assembly which supports the rotary shaft.

In rotary pumps of this type, since the fluid to be pumped is present throughout the interior pump, plain bearings must be used to support the rotor. In addition, by apparent reasons, the plain bearings cannot be oil-lubricated, but are lubricated by the pumped medium itself. However, the rotary pumps are very often used for pumping fluids such as acids, leaches, solving means and highly reactive fluids which explode when in contact with oxygen, none of which have favourable lubricating properties. Thus, plain bearing assemblies made of a hard ceramic material have been developed which last very long despite the unfavourable conditions.

For proper lubrication of the bearing assembly, it is necessary for the interior of the pump to be maintained substantially filled with the pumped medium at all times during operation. During operation, a secondary flow of fluid within the pump circulates due to pressure differences at the start and the end respectively of the secondary flow, and this flow lubricates and cools the bearing assembly. However, dry running of the pump may occur, after the system which includes the pump is drained, or the pump or system may develop a leak before or during operation which is not immediately detected. Thus, the secondary flow of fluid medium around and through the bearing assembly may be insufficient to provide sufficient lubrication and cooling. Accordingly, a large quantity of heat will be generated between the bearing and the shaft, eventually resulting in destruction of the bearing assembly. In addition, the pump may be installed incorrectly, for example, by reversing the electrical connections during installation, such that the impeller is turned in the wrong direction. Once again, the secondary flow of the fluid medium may be insufficient to remove enough heat from the bearing assembly to prevent damage.

SUMMARY OF THE INVENTION

The present invention is directed to a rotary fluid pump comprising a housing assembly, with the fluid to be pumped disposed in and substantially filling the interior region of the housing assembly during operation of the pump. An impeller is disposed in the housing assembly, and is supported on a rotatable shaft. A bearing assembly supports the shaft, with the fluid to be pumped lubricating the bearing assembly. A fixed ring assembly supports the bearing assembly, and includes a channel disposed above the bearing assembly and having two open ends. One of the open ends of the channel is disposed above and adjacent the bearing assembly. A scoop wheel is disposed to rotate with the impeller and shaft. The periphery of the scoop wheel is disposed adjacent the second open end of the channel. The scoop wheel continually raises fluid from a location below the location of the bearing assembly to a location above the bearing assembly, adjacent the second open end of the channel. The raised fluid flows into the channel and is circulated through and lubricates the bearing assembly.

In a further embodiment, a directing element directs the fluid into the second open end of the channel.

The present invention provides the advantage that damage to the bearing assembly is prevented even if the pump is run for long periods of time during which the housing is not substantially filled with fluid, since the bearing assembly is continually lubricated with the fluid medium remaining in the pump. This residual fluid medium remains at a location below the bearing assembly and is effectively recirculated through the bearing assembly by the scoop wheel to ensure proper lubrication and cooling, until the dry running is noticed and the pump can be switched off. The fluid circulated through the bearing assembly collects at the location below the bearing assembly so as to be available for further raising and lubrication. The scoop wheel also provides effective lubrication when the impeller is run in reverse, even if the housing remains substantially filled with fluid.

DETAILED DESCRIPTION OF THE PREFERRED EMBODIMENTS

Figure 1:
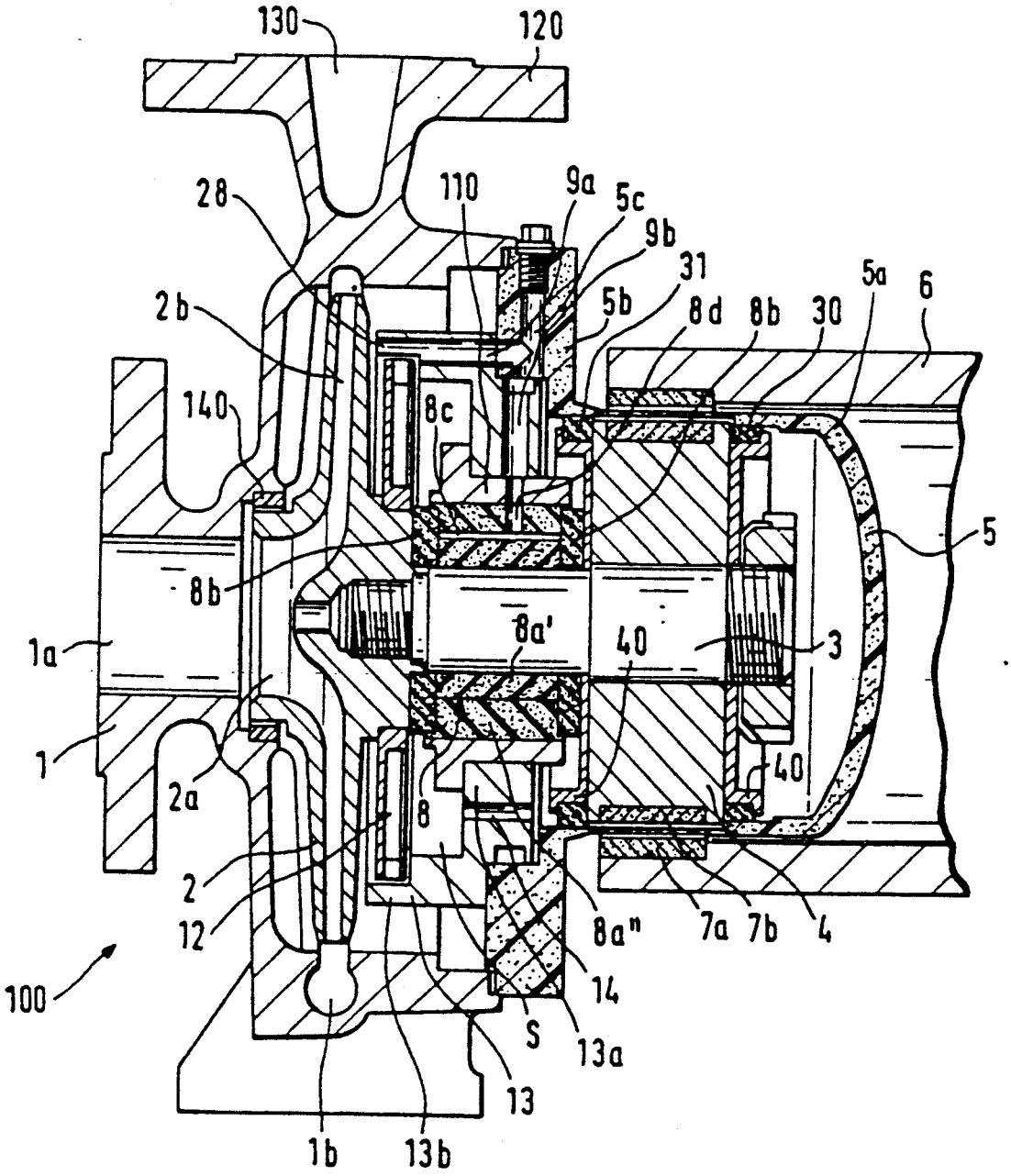
FIG. 1 is a vertical cross-sectional view through a rotary impeller pump according to the present invention.

With reference to FIG. 1, a vertical cross-sectional view of a rotary pump including a scoop wheel according to the present invention is shown. Pump 100 includes pump housing 1 having central opening 1*a* at one end. The opposite open end of pump housing 1 is closed by isolation shell 5 which is fixed to housing 1. Shell 5 includes cylindrical portion 5*a* and integral annular flange portion 5*b* which is fixed to housing 1. Shell 5 is preferably made of a non-ferromagnetic bearing-type material, for example, silicon carbide. The use of this material prevents eddycurrents and thus heat buildup within shell 5. Pump housing 1 includes groove or channel 1*b* formed on the inner surface thereof in the usual manner, which terminates into an outlet 130, shown surrounded by a flange 120.

Impeller 2 is disposed within housing 1 and includes a central projection portion through which opening 2*a* is disposed. The central projection portion is surrounded by an annular isolation ring 140. Impeller 2 includes radially extending channels 2*b* linked in fluid communication with central opening 2*a*. The opposite ends of channels 2*b* open into groove 1*b*. Opposite central opening 2*a*, impeller 2 is fixed upon one end of rotating shaft 3. Impeller 2 could be formed integrally with shaft 3. Isolation ring 140 substantially isolates the interior regions of housing 1 formed on one side of the ring from the opening 1*a*.

Shaft 3 extends from impeller 2 at one end and terminates within isolation shell 5. Rotor 4 is fixedly disposed about shaft 3 at a location within shell 5. Bearing assembly 8 supports shaft 3, at a location between impeller 2 and rotor 4. As shown, bearing assembly 8 may include radial plain bearing 8*a* disposed between two axial bearings 8*b* on either side. Of course, two radial bearings could be used. Radial bearig 8 includes inner bearing shell 8*a*' and outer bearing shell 8*a*''. Axial groove 8*c* is formed through outer shell 8*a*'' and extends the length between axial bearings 8*b*. Radial bore 8*d* is also formed through outer shell 8*a*''. Axial groove 8*c* and radial bore 8*d* allow distribution of the pumped fluid along the entire length of radial bearing 8*a* and axial bearing 8*b*. The distribution of the pumped fluid through bearing assembly 8 allows for lubrication thereof and the removal of heat. Bearing assembly 8 is preferably made from a ceramic material, for example, a non-oxide material such as silicon carbide.

Fixed ring 13 is disposed within housing 1 and supports bearing assembly 8 through bushing 110. Fixed ring 13 includes central portion 13*a* and integrally formed annular portion 13*b*. The axial end surface of annular portion 13*b* terminates adjacent the rearward surface of impeller 2. At the top side, annular portion 13*b* includes axial bore 9*a* which extends from opening 28 at one end near impeller 2, and at the other end opens into radial bore 5*c* formed through annular flange portion 5*b* of shell 5. The structure of ring 13 at the location of bore 9*a* and opening 28 will be discussed further below. Radial bore 9*b* is formed in central portion 13*a* of fixed ring 9 and is in fluid communication at one end with radial bore 5*c*. At the opposite end, radial bore 9*b* is in fluid communication with a corresponding bore formed in bushing 100, which is in communication with radial bore 8*d* formed in outer shell 8*a*''. Fixed ring 13 also includes axial bore 14 formed through central portion 13*a* at a lower location.

Scoop wheel 12 is fixedly disposed on the exterior surface of impeller 2, and is surrounded by fixed ring 13 with minimal play. Scoop wheel 12, fixed ring 13, and bushing 110 enclose annular space S, and fluid dripping out of bearing assembly 8 collects in the bottom portion of space S. During normal operation, the pressure of the fluid in space S will generally be lower than the exit pressure of the pump. Space S is linked to the region to the rear of ring 13 by bore 14, and this region is further linked to the space within isolation shell 5 and to the rear of rotor 4.

Rotor 4 is fixed upon shaft 3 rearwardly of bearing assembly 8. Rotor 4 is disposed between flanges 40 which are also disposed about shaft 3. Flanges 40 support rings 30 and 31 which are made of a bearing material, for example, silicon carbide. A small amount of play is permitted between rings 30 and 31 and the inner surface of isolation shell 5. Rings 30 and 31 serve as emergency bearings in the event that bearing assembly 8 is severely damaged or destroyed, by supporting shaft 3 through rotor 4. An emergency bearing of this type is disclosed in German Patent Application No. P 39 41 444.2. The ends of shaft 3 are screw threaded, and impeller 2 acts as a nut which is screwed upon the forward end of shaft 3 to secure bearing assembly 8 and forward flange 40 on shaft 3, and shaft nut 30 secures rearward flange 40 on shaft 3.

A plurality of permanent magnets 7*a* are disposed about the exterior surface of rotor 4. A small gap is maintained between magnets 7*a* and the interior surface of isolation shell 5. Adjacent magnets 7*a* disposed on rotor 4 have opposite poles facing the interior surface of shell 5. Cylindrical driver or outer rotor 6 is disposed about shell 5, and includes a plurality of permanent magnets 7*b* disposed circumferentially along the interior surface. Adjacent magnets 7*b* have opposite poles facing the exterior surface of shell 5, with each magnet 7*b* facing the opposite pole of one corresponding magnet 7*a*, to obtain a magnetic coupling between rotor 4 and driver 6. Driver 6 is disposed on a further shaft which is not shown, and which is driven by an external motor which is also not shown. Accordingly, rotation of driver 6 by the unshown shaft and motor causes corresponding rotation of rotor 4, shaft 3 and impeller 2. Since isolation shell 5 is not made from an electrically conductive material, no eddycurrents are created which would cause the generation of heat. Fluid is maintained between both the surfaces of magnets 7*a* and the exposed surface of rotor 4, and the interior surface of shell 5. Thus, rotor 4 and shell 5 act as a hydrodynamical bearing to stabilize shaft 3 and impeller 2 during normal operation. During normal operation, fluid flows between the region to the front of and to the rear of rotor 4 through the gaps formed between rotor 4 and shell 5, and rings 30 and 31 and shell 5, and this circulation of fluid cools rotor 4, magnets 7*a* and shell 5 at this location.

Figure 2A:
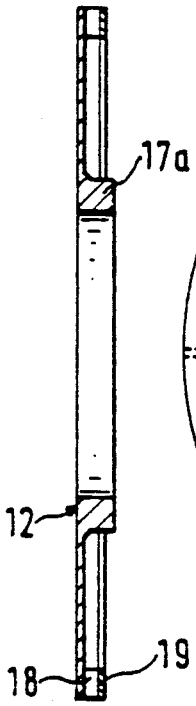
FIG. 2*a* is a cross-sectional view of a scoop wheel according to a first embodiment of the present invention.

With reference to FIGS. 2 and 2*a*, a first embodiment of scoop wheel 12 is shown. Scoop wheel 12 includes flat disk 17 having hub section 17*a* and a plurality of perpendicularly extending blades 18 projecting from one surface. Blades 18 are radially oriented and substantially equiangularly disposed around the circumference of flat disk 17. Hub 17*a* is disposed about the rear portion of impeller 2. Scoop wheel 12 may also include ring 19 which is disposed over and closes blades 18.

Rotary pump 100 operates as follows. Before operation of the rotary pump, the interior of the pump is completely filled with the medium to be pumped by filling the system to which the pump belongs. The fluid flows through central opening 1*a* and opening 2*a* of impeller 2, and further flows into all of the interior cavities and spaces of pump 100 through various gaps. Air is expelled out of outlet opening 130. Thus, pump 100 is substantially completely filled with fluid at all places, including space S and the region within shell 5. Thereafter, operation of the pump commences, with impeller 2 rotated by action of shaft 3 and rotor 4.

As discussed above, during normal pump operation, the entire interior of housing 1 and isolation shell 5 remain filled with the fluid. Thus, due to pressure differentials created between different locations within the interior of housing 1, fluid flows through and lubricates and cools bearing assembly 8. If the pump runs dry by whatever reasons, a residual quantity of fluid remains in the housing if horizontally disposed. In particular, a residual pool of fluid medium will remain in space S due to the provision of fixed ring 13. In the present invention, scoop wheel 12 makes use of this residual fluid to lubricate and cool bearing assembly 8 in order to prevent damage to the bearing assembly.

Figure 2B:
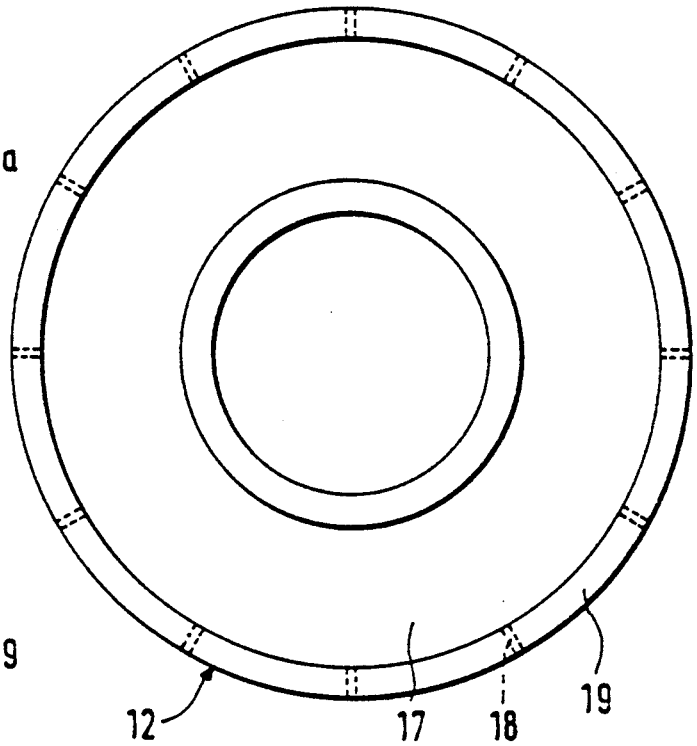
FIG. 2*b* is a front view of a scoop wheel according to a first embodiment of the present invention.

With reference to FIGS. 1, 2*a* and 2*b*, as scoop wheel 12 is rotated, the peripheral surface of scoop wheel 12 and each blade 18 is immersed in the pool of residual fluid space S such that the fluid is "scooped" out of the pool. The scoop wheel effectively acts as an impeller, and the scooped fluid will form a rotating fluid ring about the periphery of the wheel. When the fluid is at the top position, it is adjacent opening 28 formed in ring 13. The fluid flows through opening 28 and, sequentially into channel 9*a*, bore 5*c*, channel 9*c*, through the bore in bushing 110 and through radial bore 8*d* in bearing assembly 8 to provide lubrication and cooling. The fluid is circulated throughout the length of axial bearing 8*a* and to each radial bearing 8*b* via groove 8*c*. After the fluid has flown completely through bearing assembly 8, it drips back into the pool of fluid collected in space S and is again scooped up by scoop wheel 12 and recirculated through bearing 8. By recirculating the fluid in this manner, a steady state temperature is quickly reached, and this temperature may be maintained for a long period, which will usually be long enough for the improper running condition of the pump to be detected. In addition, scoop wheel 12 also serves to assist in lubrication of bearing assembly 8 during normal operation, although the primary lubrication is provided by the creation of secondary flow of fluid within housing 1 due to the pressure differential.

Figure 3A:
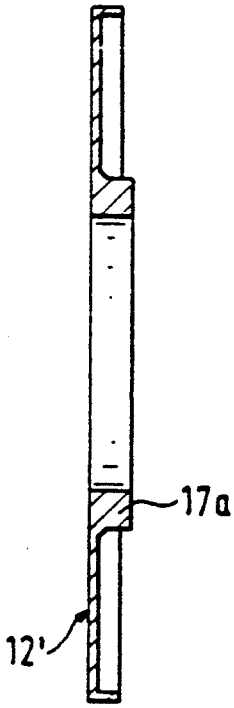
FIG. 3*a* is a cross-sectional view of a scoop wheel according to a second embodiment of the present invention.
Figure 3B:
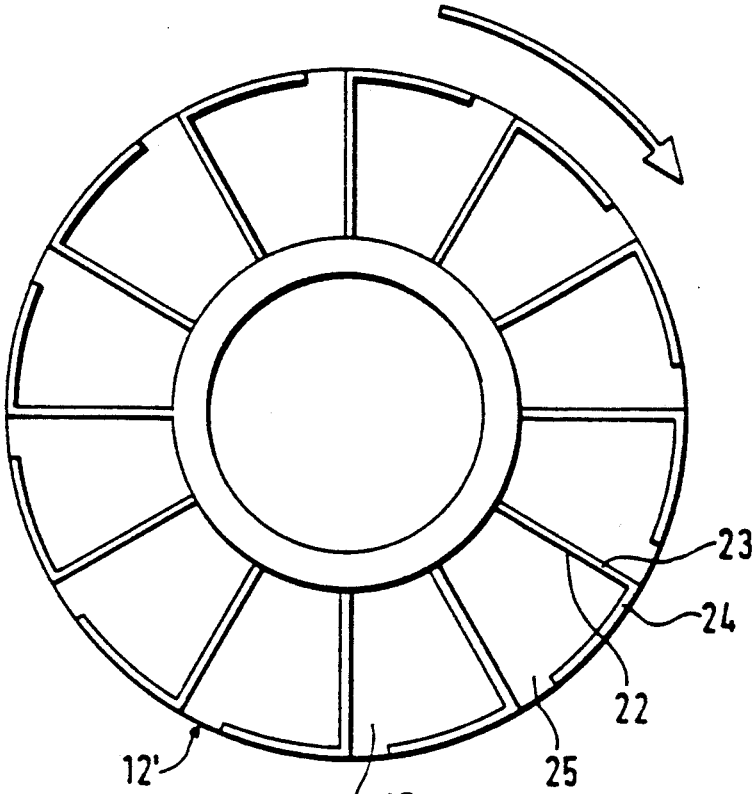
FIG. 3*b* is a front view of a scoop wheel according to a second embodiment of the present invention.
Figure 4A:
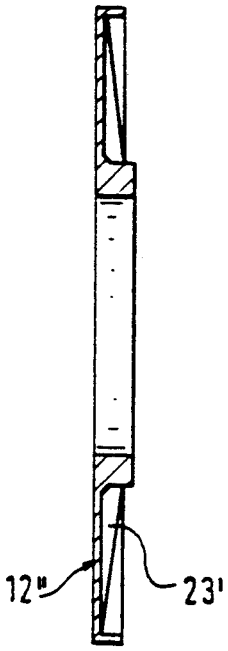
FIG. 4*a* is a cross-sectional view of a scoop wheel according to a third embodiment of the present invention.
Figure 4B:
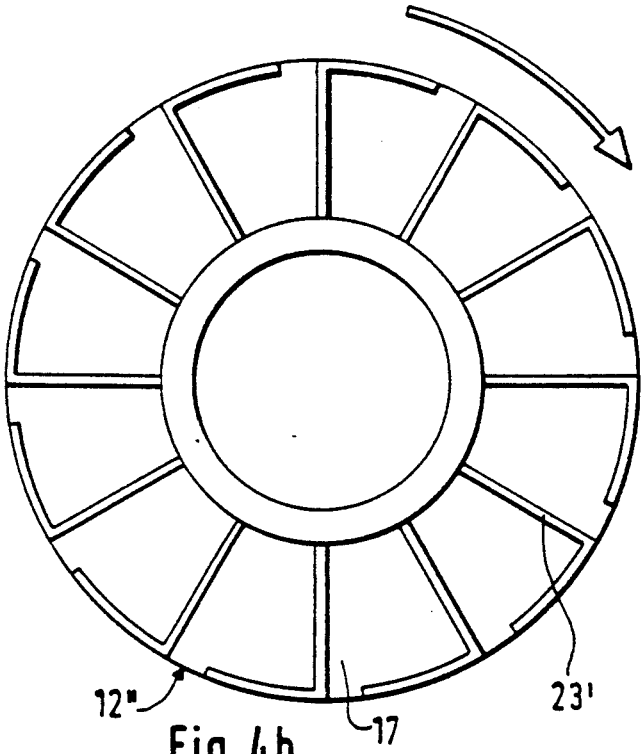
FIG. 4*b* is a front view of a scoop wheel according to a third embodiment of the present invention.
Figure 5A:
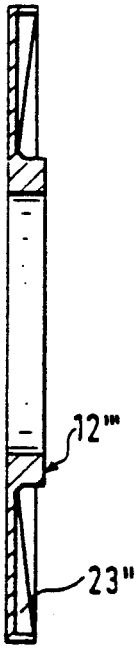
FIG. 5*a* is a cross-sectional view of a scoop wheel according to a fourth embodiment of the present invention.
Figure 5B:
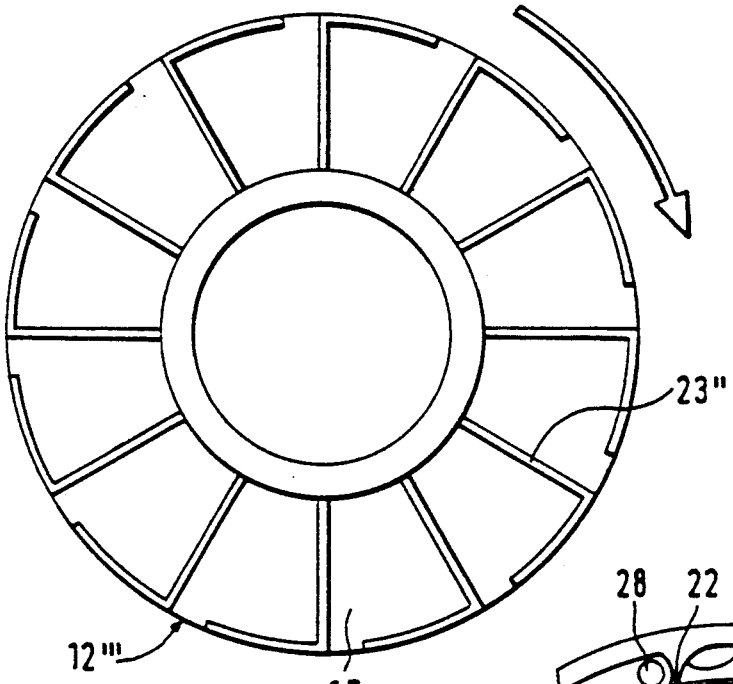
FIG. 5*b* is a front view of a scoop wheel according to a fourth embodiment of the present invention.

With reference to FIGS. 3*a* and 3*b*, a second embodiment of scoop wheel is shown. Scoop wheel 12' includes disk 17 having hub section 17*a*. Webs 22 extend normally from one surface of disk 17. Webs 22 include first section 23 extending radially outwardly from hub 17*a*, and integrally formed second sections 24 extending from the outer edge of first sections 23 and along the circumference of disk 17. Windows 25 are provided between adjacent webs 22. FIGS. 4*a*, 4*b*, 5*a* and 5*b* show similar embodiments 12'' and 12''' of the scoop wheel. In FIGS. 4*a* and 4*b*, the heights of first sections 23'' from the plain of disk 17 decrease in the radially outward direction. In FIGS. 5*a* and 5*b*, the heights of first sections 23''' increase in the radially outward direction. The selection of which scoop wheel is used depends upon the type and viscosity of the fluid to be pumped.

Figure 6:
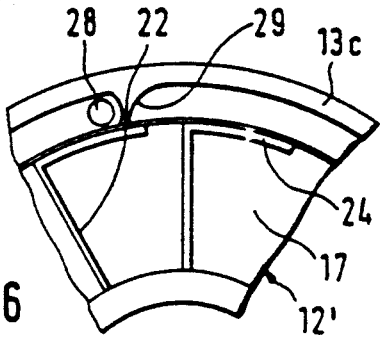
FIG. 6 is a partial closeup view of a mechanism for directing the flow of the fluid from the scoop wheel into a channel for recirculation.

With reference to FIG. 6, the manner in which fluid flows from the scoop wheel and into opening 28 is disclosed. Annular portion 13*a* includes annular extending portion 13*c* having a decreased thickness and which extends almost to impeller 2. Thus, the periphery of scoop wheel 12 is disposed within the empty annular space defined radially within extending portion 13*c*, and adjacent the axial edge of annular portion 13*a*. Channel 9*a* is disposed through annular portion 13*a* and terminates at opening 28 which is slightly displaced from the 12 o'clock position, as shown in FIG. 6. Directing element 29 projects downwardly from annular portion 3*a*, forward of opening 28 with respect to the rotating direction that is, at a location slightly closer to the 12 o'clock position than opening 28. Element 29 terminates radially outwardly of scoop wheel 12 so as to not impede rotation. Thus, directing element 29 in conjunction with opening 28 provides an entry groove for the fluid. As the scoop wheel rotates, fluid raised to the top of the wheel is automatically guided into the groove by element 29. The fluid is raised either by blades 18 if a scoop wheel according to FIGS. 2*a* and 2*b* is used or by a friction effect between the outside of sections 24 of webs 22 and the fluid if a scoop wheel according to FIGS. 3*a* to 5*b* is used.

Although particular embodiments of the scoop wheel have been shown, the invention is not limited thereto. Other devices which work under high rates of revolution and serve to transport sufficient quantities of residual fluid in a manner in which this fluid is recirculated throughout the bearing assembly, are within the scope of the invention. In addition, other elements which direct the flow of fluid into groove 9 are within the scope of the invention, so long as a small amount of fluid is reliably delivered into bearing assembly 8. For example, instead of the directing element 29 the opening 28 can be placed higher up away from the scoop wheel 12 and end in a cavity which is the "deepest" point in the section of ring 13 surrounding scoop wheel 12. Due to the centrifugal forces this cavity is permanently filled with fluid and will deliver into the bore 9*a*. The term rotary pump includes centrifugal pumps, and all pumps having an impeller, for example, peripheral pumps, and the invention may be used with all such pumps.

During normal operation, the function of the scoop wheel is identical to that during an emergency situation. Since pump housing 1 will be completely filled with fluid, a much higher volume of fluid will be delivered than can flow into opening 28. Of course, normal lubrication is provided by the secondary flow. Heat is exchanged between the fluid of the secondary flow and the fluid being pumped out of outlet 130 due to the various gaps between the components disposed within the housing. This heat exchange is sufficient to carry away the heat generated by friction at bearing assembly 8.

In addition, the provision of channel 14 through ring 13 ensures that the fluid within isolated shell 5 will be fully utilized for lubrication of bearing assembly 8 should the pump be operated with insufficient fluid for normal lubrication, since channel 14 opens into space S. Thus, most of the fluid contained within isolation shell 5 will be retained in space S. Of course, even if space S is not formed, the fluid medium will still collect in the bottom of pump housing 1 and be recirculated through bearing assembly 8. As shown in the Figures, the diameter of scoop wheel 12 is adapted with respect to the diameter of the housing and so as to ensure recirculation of the residual fluid even when the pump has been drained via the inlet. If different designs are used, the pump must be configured to prevent complete drainage even if the inlet is temporarily removed.

I claim:

1. A rotary fluid pump comprising:

a housing assembly, the fluid to be pumped disposed in and substantially filling the interior region of said housing assembly during operation of said pump;

an impeller disposed in said housing assembly, said impeller supported on a rotatable shaft;

a bearing assembly supporting said shaft, the fluid to be pumped lubricating said bearing assembly;

a fixed ring assembly disposed within said housing assembly and supporting said bearing assembly;

and scoop means for supplying fluid to said bearing assembly, said scoop means and said fixed ring assembly defining a substantially isolated space therebetween in which a supply of the pumped fluid may be substantially isolated from the remainder of the fluid in said housing, said scoop means ensuring that fluid is supplied to said bearing assembly in the situation when said pump operates when said interior region is not substantially filled with fluid, said scoop means recirculating residual fluid in said substantially isolated space to lubricate said bearing assembly.

2. The rotary pump recited in claim 1, further comprising a channel formed through said housing assembly at a location above said bearing assembly when said pump is in the normal operating position, said channel having first and second openings, said first opening adjacent said scoop means and said second opening adjacent said bearing assembly, said scoop means continually raising the residual fluid and delivering it to said first opening such that said fluid flows through said channel and out of said second opening to lubricate said bearing assembly.

3. The rotary pump recited in claim 2, further comprising directing means for directing said fluid into said first opening of said channel.

4. The rotary pump recited in claim 2, said scoop means comprising a rotating scoop wheel.

5. The rotary pump recited in claim 4, said fixed ring assembly disposed about said scoop wheel, said channel formed at least partially in said fixed ring assembly.

6. The rotary pump recited in claim 5, said scoop wheel comprising a flat disk having a plurality of webs extending from one surface thereof, each said web having a first section extending radially outwardly towards the circumference of said disk and a second section extending along the circumference of said disk.

7. The rotary pump recited in claim 6, each said first section increasing in height from the surface of said disk in the radially outward direction.

8. The rotary pump recited in claim 6, each said first section increasing in height from the surface of said disk in the radially inward direction.

9. The rotary pump recited in claim 4, said scoop wheel comprising a flat disk having a plurality of blades extending perpendicularly from one surface, said blades extending in the radial direction and disposed circumferentially about said one surface.

10. The rotary pump recited in claim 9, said scoop wheel further comprising a ring disposed over said blades.

11. The rotary pump recited in claim 4, said scoop wheel comprising a flat disk having a plurality of webs extending from one surface thereof, each said web having a first section extending radially outwardly towards the circumference of said disk and a second section extending along the circumference of said disk.

12. The rotary pump recited in claim 11, each said first section increasing in height from the surface of said disk in the radially outward direction.

13. The rotary pump recited in claim 11, each said first section increasing in height from the surface of said disk in the radially inward direction.

14. The rotary pump recited in claim 1, said fixed ring assembly disposed within said housing assembly about said scoop means, said substantially isolated space formed on one side of said bearing assembly, a second space formed on the opposite side of said bearing assembly, said substantially isolated space and said second space linked by a channel disposed through said fixed ring assembly below said bearing assembly.

15. The rotary pump recited in claim 14, said housing assembly including a pump housing having an isolation shell disposed on and enclosing one open end of said pump housing, said second space formed within said isolation shell.

16. The rotary pump recited in claim 1, said fixed ring assembly including a channel disposed above said bearing assembly and having two open ends, one said open end disposed above and adjacent said bearing assembly, the periphery of said scoop means disposed adjacent the second open end of said channel.

17. The pump recited in claim 16, said scoop means raising fluid from a lower location in said housing assembly to a location adjacent said channel, said fixed ring assembly including direction means for directing fluid from said scoop element and into said second open end of said channel.

18. The pump recited in claim 1, said scoop means comprising a scoop wheel, said scoop wheel disposed generally within the outer circumference of said fixed ring assembly.

* * * * *